US006010380A

United States Patent [19]

Wollard

[11] Patent Number: 6,010,380

[45] Date of Patent: Jan. 4, 2000

[54] MARINE EXHAUST VENTED FORWARD OF PROPELLER HUB

[76] Inventor: Donald L. Wollard, 105 Bayview Dr., Islamorada, Fla. 33036

[21] Appl. No.: 09/370,432

[22] Filed: Aug. 9, 1999

[51] Int. Cl.[7] ..... B63H 21/32

[52] U.S. Cl. ..... 440/89; 416/93 A

[58] Field of Search ..... 440/89; 416/93 R, 416/93 A

[56] References Cited

U.S. PATENT DOCUMENTS

| | | | |
|---|---|---|---|
| 3,434,447 | 3/1969 | Christensen et al. | 440/89 |
| 3,745,964 | 7/1973 | Henrich | 440/89 |
| 3,919,965 | 11/1975 | Ross | 440/89 |
| 4,373,922 | 2/1983 | Weed | 440/89 |
| 4,545,771 | 10/1985 | Iio | 440/89 |
| 4,773,215 | 9/1988 | Winberg et al. | 440/89 |
| 4,802,872 | 2/1989 | Stanton | 440/89 |
| 4,871,334 | 10/1989 | McCormick | 440/89 |
| 4,891,025 | 1/1990 | Brandt | 440/66 |
| 4,911,665 | 3/1990 | Hetzel | 440/89 |
| 5,145,428 | 9/1992 | Harrison | 440/89 |
| 5,816,869 | 10/1998 | Willows | 440/89 |
| 5,857,880 | 1/1999 | Harada | 440/89 |

*Primary Examiner*—Sherman Basinger
*Attorney, Agent, or Firm*—Alvin S. Blum

[57] ABSTRACT

An exhaust system for marine propulsion units passes engine exhaust gas out through lateral holes in the lower unit casing at the level of the propeller shaft that communicate between an exhaust passage in the propeller-shaft-support unit and the ambient water. This venting mechanism discharges gas at the level of the propeller hub when the vessel is moving slowly. The vented gas enables the engine to rapidly increase its RPM s without excessive engine loading. This allows for increased acceleration and less engine damage. The system may include venting gas though the hub and out the aft end of the propeller. The system may be used with outboard engines, inboard/outdrives, and full inboards. When used with full inboards, a valve mechanism may enable diversion of an adjustable fraction of the exhaust gas through the transom. A drain hole may also be provided to drain water from the gas passage when the lower unit is out of the water.

20 Claims, 3 Drawing Sheets

MARINE EXHAUST VENTED FORWARD OF PROPELLER HUB

BACKGROUND OF THE INVENTION

This invention relates to marine engine exhaust systems, and more particularly to systems which send engine exhaust gas from the sides of the lower unit of outdrives and outboard engines or the propeller support strut of inboard engines to flow around the hub of the propeller for enhanced acceleration at low vessel speeds.

DESCRIPTION OF THE PRIOR ART

It is well known in the art to send engine exhaust gas through the hub of the propeller to flow astern of the propeller. This reduces noise and fumes in the cockpit. It is also well known to send exhaust out the back of the gear case to flow against a portion of the uppermost blade at low velocities to simulate the propeller load at high speeds when the boat is on plane, and that portion of the blade will be out of the water. This reduces the load on the propeller and enables it to get up to a higher rotational speed for more rapid acceleration without damage to the engine. It "unloads" the engine. It is also well known to exhaust gas through vents in the propeller hub forward of the blades. These auxiliary vents have the additional advantage of reducing exhaust back pressure at low velocity when the area astern of the hub does not have reduced pressure to pull out exhaust gas. The vents are closed at high speed when they would cause harmful cavitation. Exhausting gas astern of the propeller not only keeps the fumes away from the passengers, but it also reduces drag by filling the low pressure volume astern of the vessel. The devices of the prior art that provide underwater vents at the lower unit or propeller have a tendency to retain water in the exhaust passages when tilted up. This can cause costly damage when the water freezes. Salt water remaining in the lower unit can also cause corrosion and electrolysis.

SUMMARY OF THE INVENTION

It is accordingly an object of the invention to provide a marine exhaust system that enables the engine to rapidly increase its speed of rotation or RPM at low vessel velocity without causing an excessive load on the engine, to enhance acceleration. It is another object of the invention to provide a more symmetrical venting at the propeller to balance the load on the bearings. It is yet another object to provide reduced drag on the lower unit by providing a stream of gas around the lower unit.

The marine exhaust system of the invention comprises an engine exhaust passage that conveys the engine exhaust gasses down through the lower unit and out through vents so positioned at the sides of the lower unit that the gas is directed substantially symmetrically around the propeller hub when the vessel is moving forward at low speeds. The vents may be holes drilled through the wall of the lower unit at any angle. The diameter and number of such holes will be determined by the particular configuration. This is generally used in combination with a system for venting exhaust gas through the aft end of the propeller hub. The invention is also applied to a full inboard engine installation, in which the strut supporting the propeller shaft bearing includes exhaust gas passage means and vents at the sides of the strut for directing the gas out the sides of the strut to then flow aft symmetrically around the propeller hub. This arrangement may include passing exhaust gas downstream out through the propeller hub in a manner used by outboard engines. It is yet another object of the invention to provide at least one drain hole at a lowermost point on the exhaust passage to ensure drainage of water from the passage and prevent corrosive, electrolytic and freezing damage.

This invention may be employed with various types of engines, including, for example, atomic power, turbines, and internal combustion. The invention may be employed with various types of drives, including, for example, surface drives, inboard/out drives, and full inboard drives. The propellers may provide though hub exhaust directed astern, if desired.

The term "ambient water" will be used to describe the water in or on which the vessel travels.

These and other objects, features and advantages of the invention will become more apparent when the detailed description is studied in conjunction with the drawings, in which like reference characters indicate like elements in the various drawing figures.

DETAILED DESCRIPTION OF PREFERRED EMBODIMENTS

Figure 1:
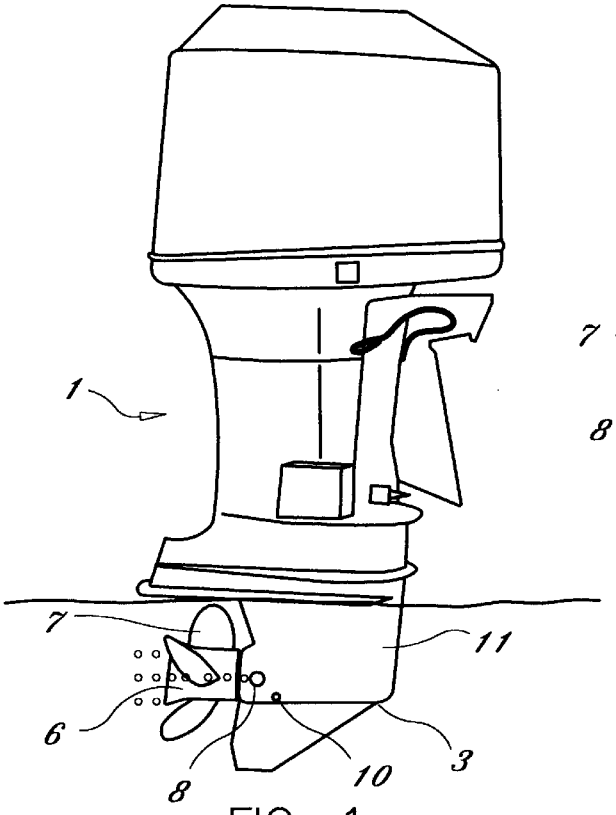
FIG. 1 is a side elevation view of an outboard motor embodiment of the invention.
Figure 3:
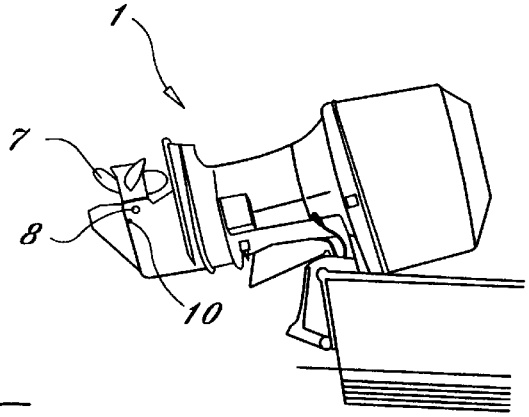
FIG. 3 is a side elevation view of the motor of FIG. 1 on a boat transom and tilted up.
Figure 2:
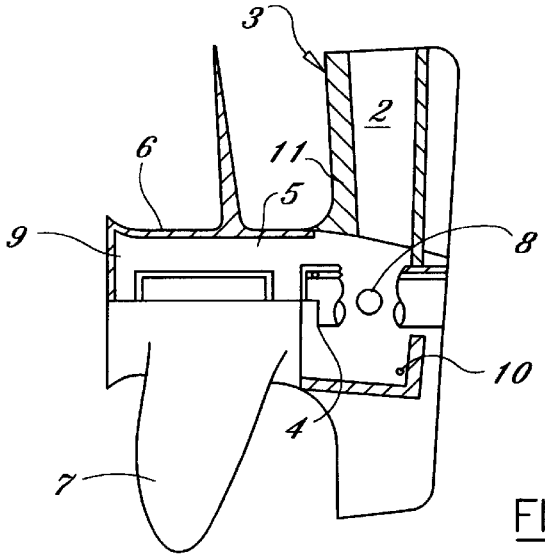
FIG. 2 is an enlarged fragmentary vertical generally sectional view of the lower aft portion of the device of FIG. 1.

Referring now first to FIGS. 1–3, an embodiment of the invention is shown in the form of an outboard motor 1 that is conventional in most respects, having an internal engine exhaust passage 2 that extends down into the lower unit 3. A propeller shaft 4 is rotationally supported by the lower unit. The passage 2 surrounds the shaft 4 and communicates with an annular space 5 in the hub 6 of the propeller 7 that is open astern at opening 9. The exhaust gas thus exits through the propeller hub and fills the low pressure space astern of the propeller when moving forward. This increases efficiency as well as reducing back pressure. It also reduces noise and fumes in the cockpit. All of the above are well known in the art. The instant invention improves the art with the vent holes 8 that extend from the exhaust passage 2, one on each side of the shaft 4, and through the outer casing 11 on the port side and on the starboard side of the casing to the ambient water at the level of the propeller shaft. They are so positioned that exhaust gas will pass out the holes 8 and stream back along the hub 6 when the boat is moving forward. At low forward speeds, it has been found that these gasses reduce the loading on the propeller blades enough so that the engine revolutions can be much more rapidly increased without undue strain on the engine. The increased acceleration is a great enhancement of performance. The vent holes do not adversely affect high-speed performance. A further improvement is provided by the at least one drain hole 10 that is so positioned that it drains the exhaust gas passage 2 of water when the motor is tilted up out of the water. Drain hole 10 may be much smaller than vent holes 8 since it only has to drain water slowly from the exhaust passage 2. All holes 8 and 10 provide open communication between ambient water and the passage 2 at all engine RPM s for a very simple construction of a new motor or retrofit of an existing motor. More than one vent hole 8 may be provided on each side of the casing as required, and the diameter of the vent holes and their angles through the casing may be adjusted to suit a particular application.

Figure 4:
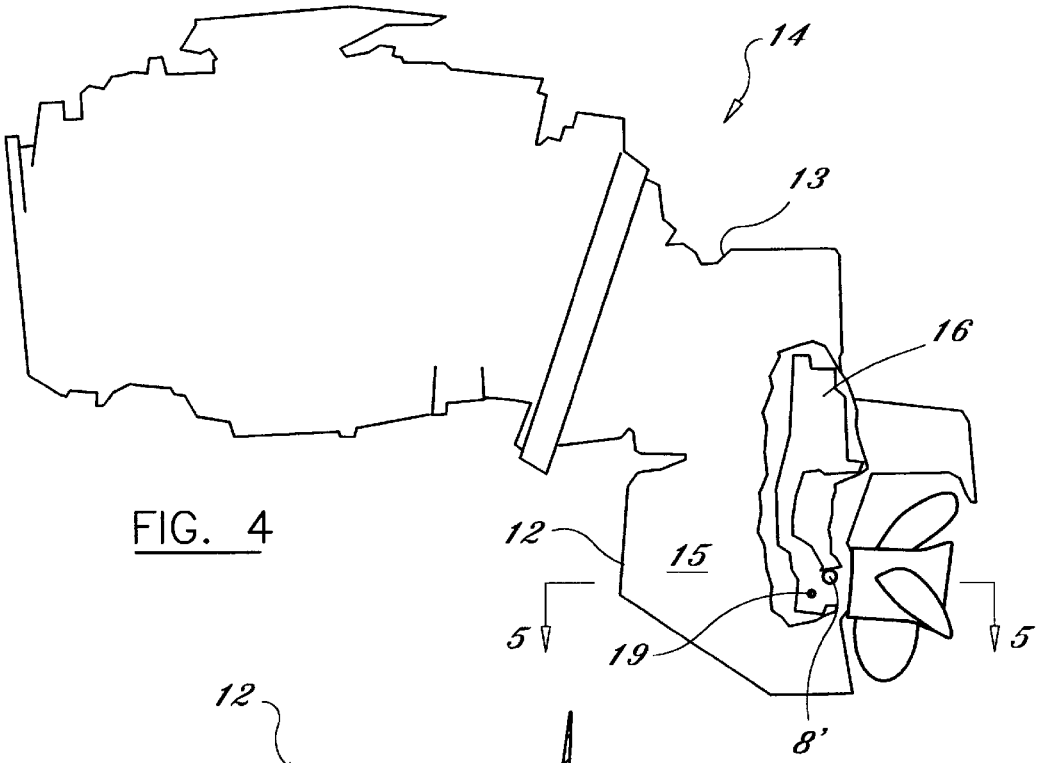
FIG. 4 is a side elevation view of an inboard/outdrive propulsion unit of the invention partially broken away.
Figure 5:
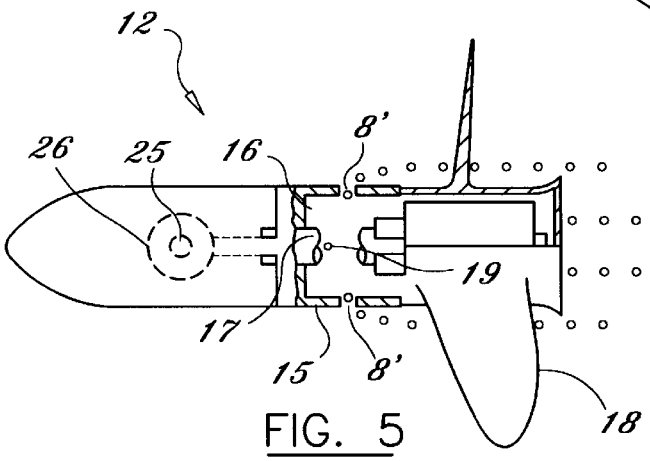
FIG. 5 is an enlarged fragmentary horizontal generally sectional view taken through line 5—5 of FIG. 4.

Referring now to FIGS. 4 and 5, another embodiment of the invention is shown in which the lower unit 12 of the outdrive 13 of an inboard/outdrive assembly 14 of generally conventional construction provided with vertical shaft 25 driving propeller shaft 17 through angle gear 26 is provided with vent holes 8' through the casing 15 that provide communication between the internal exhaust gas space 16 and the ambient water at the level of the propeller shaft 17. The gas bubbles discharged from the vents drift back alongside the hub of propeller 18, as described above. A drain hole 19 may also be provided.

Figure 6:
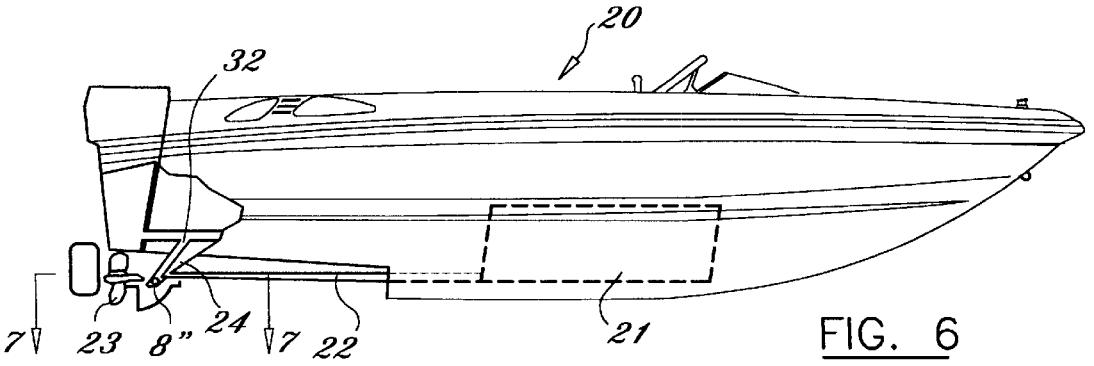
FIG. 6 is a side elevation view, partially broken away, of another embodiment of the invention with a full inboard engine installation.
Figure 7:
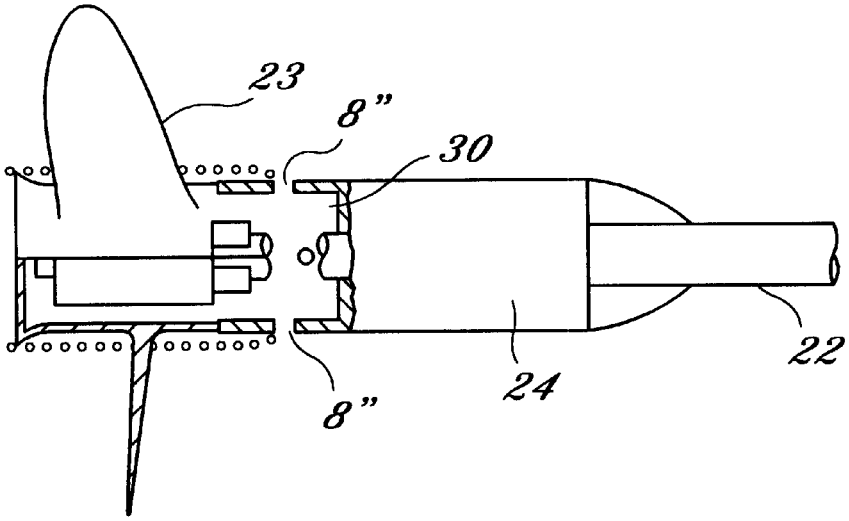
FIG. 7 is an enlarged fragmentary horizontal generally sectional view taken through line 7—7 of FIG. 6.
Figure 8:
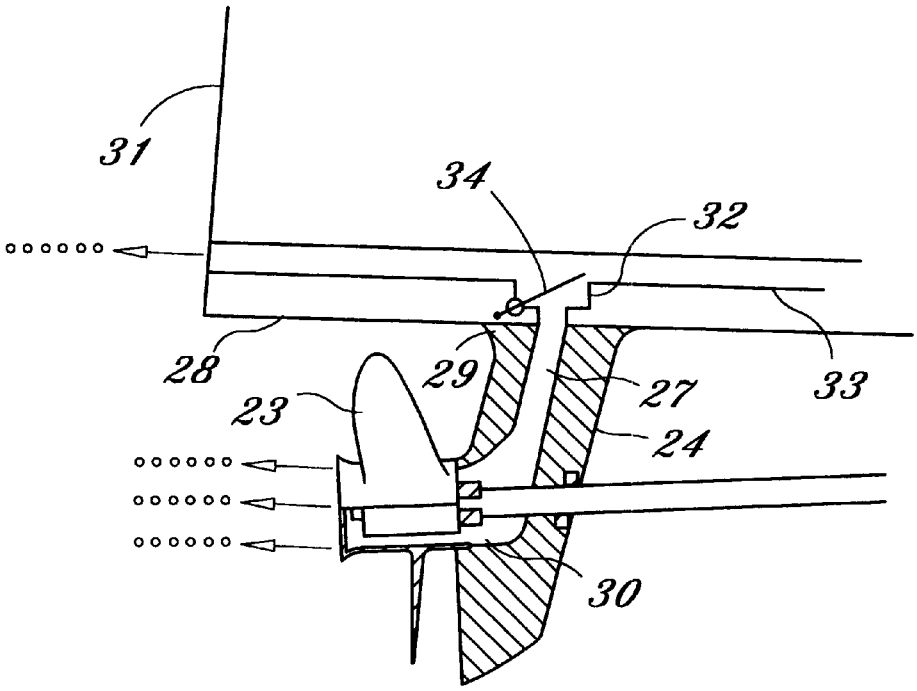
FIG. 8 is an enlarged detail diagrammatic view of a portion of FIG. 6.

Referring now to FIGS. 6–8, another embodiment of the invention is shown for a boat 20, with twin inboard engines 21, only one of which is shown. A straight drive shaft 22 transmits power to propeller 23. The propeller-shaft-supporting lower unit, or strut, 24 is not of conventional construction. It is constructed with an exhaust gas passage 27 which extends from the hull bottom 28 to which it is sealed by gasket 29 down to a horizontal portion where it communicates with the annular space of the propeller, as described above for other embodiments. Lateral exhaust gas vents 8" in the outer casing of strut 24 function as described for the other embodiments. As best seen in FIG. 8, exhaust gas from engine 21 passes astern to discharge through transom 31 in a conventional manner. The improvement comprises a T connection 32 in the horizontal exhaust pipe 33. With valve 34, the fraction of the exhaust gas that is diverted to flow down into the strut is adjustable as desired. Diverted gas flows down into the exhaust passage 27 where it can enhance acceleration at low vessel speed and serve ather function as described supra. The nature of this type of valve prevents total blockage of the exhaust which could damage the engine.

The above disclosed invention has a number of particular features which should preferably be employed in combination, although each is useful separately without departure from the scope of the invention. While I have shown and described the preferred embodiments of my invention, it will be understood that the invention may be embodied otherwise than as herein specifically illustrated or described, and that certain changes in form and arrangement of parts and the specific manner of practicing the invention may be made within the underlying ideas or principles of the invention.

What is claimed is:

1. In a marine propulsion system for a vessel adapted to travel on ambient water and having an engine that emits exhaust gas, a propeller shaft for rotating a propeller having a hub and blades extending radially from the hub, and a propeller-shaft-supporting lower unit having an outer casing with port and starboard sides disposed forward of the propeller, the improvement comprising:

a) exhaust passage means within the lower unit for conveying exhaust gas down to a level corresponding to the propeller shaft level;

b) a least one exhaust gas vent to ambient water located on the port side of the casing and at least one exhaust gas vent to ambient water located on the starboard side of the casing, the vents being in communication with the exhaust passage means and being located at said propeller shaft level so as to discharge exhaust gas substantially symmetrically about the propeller hub as the vessel moves forward at low velocity, the communication being patent at all rotational speeds; and c) at least one drain hole in communication with the exhaust passage means and being so located as to enable substantially complete drainage of the exhaust passage when the lower unit is not immersed.

2. The system according to claim 1, in which the lower unit includes a system for exhausting gas from the exhaust passage means through the hub of the propeller and out an aperture astern of the blades.

3. The system according to claim 2, in which the lower unit is part of an outboard engine.

4. The system according to claim 2, in which the lower unit is part of an outdrive unit.

5. The system according to claim 2, in which the lower unit is part of a full inboard engine installation.

6. The system according to claim 5, in which a fraction of the exhaust gas is vented through the lower unit and the fraction is adjustable.

7. The system according to claim 2, in which the drain hole drains effectively when the lower unit is tilted up.

8. The system according to claim 1, in which the lower unit is part of a full inboard engine installation.

9. The system according to claim 8, in which a fraction of the exhaust gas is vented through the lower unit and the fraction is adjustable.

10. The system according to claim 1, in which the drain hole drains effectively when the lower unit is tilted up.

11. In a marine propulsion system for a vessel adapted to travel on or in ambient water and having an engine that emits exhaust gas, a propeller shaft for rotating a propeller having a hub and blades extending radially from the hub, and a propeller-shaft-supporting lower unit having an outer casing with port and starboard sides disposed forward of the propeller, the improvement comprising:

a) exhaust passage means within the lower unit for conveying exhaust gas down to a level corresponding to the propeller shaft level; and b) a least one exhaust gas vent to ambient water located on the port side of the casing and at least one exhaust gas vent to ambient water located on the starboard side of the casing, the vents being in communication with the exhaust passage means and being located at said propeller shaft level so as to discharge exhaust gas substantially symmetrically about the propeller hub as the vessel moves forward at low velocity, the communication being patent at all rotational speeds.

12. The system according to claim 11, in which the lower unit includes a system for exhausting gas from the exhaust passage means through the hub of the propeller and out through an aperture astern of the blades.

13. The system according to claim 12, in which the lower unit is part of a full inboard unit.

14. The system according to claim 13, in which a fraction of the exhaust gas is vented through the lower unit, and the amount of the fraction is adjustable.

15. The system according to claim 12, in which the lower unit is part of an outboard motor.

16. The system according to claim 12, in which the lower unit is part of an outdrive unit.

17. The system according to claim 11, in which the lower unit is part of an outboard engine.

18. The system according to claim 11, in which the lower unit is part of an outdrive unit.

19. The system according to claim 11, in which the lower unit is part of a full inboard unit.

20. The system according to claim 19, in which a fraction of the exhaust gas is vented through the lower unit, and the amount of the fraction is adjustable.

* * * * *